United States Patent [19]

Reese

[11] Patent Number: 4,582,030

[45] Date of Patent: Apr. 15, 1986

[54] MOUNTING RECOIL STARTER

[75] Inventor: Paul T. Reese, New Holstein, Wis.

[73] Assignee: Tecumseh Products Company, Tecumseh, Mich.

[21] Appl. No.: 585,899

[22] Filed: Mar. 2, 1984

[51] Int. Cl.[4] ..... F02N 3/02

[52] U.S. Cl. ..... 123/185 B; 123/179 SE; 123/185 BA; 74/6; 74/577 SF; 185/39; 192/46

[58] Field of Search ..... 123/185 BA, 185 B, 185 A, 123/185 R, 179 SE; 74/6, 577 SF, 577 S; 185/39; 192/46

[56] References Cited

U.S. PATENT DOCUMENTS

| | | | |
|---|---|---|---|
| 2,227,392 | 12/1940 | Kuzmitz | 185/40 |
| 2,500,076 | 3/1950 | Honeyman | 123/185 BA |
| 2,563,719 | 8/1951 | Goldberg et al. | 123/185 |
| 3,032,024 | 5/1962 | Furlong | 123/179 SE |
| 3,127,884 | 4/1964 | Rice | 123/185 BA |
| 3,134,376 | 5/1964 | Rice | 123/185 BA |
| 3,366,099 | 1/1968 | Kaufman | 123/185 |
| 3,370,464 | 3/1971 | Morabit et al. | 123/185 |
| 3,375,813 | 4/1968 | Hamman | 123/185 |
| 3,375,814 | 4/1968 | Hamman | 123/185 |
| 3,730,162 | 5/1973 | Murase | 123/185 BA |
| 3,782,355 | 1/1974 | Hamman | 123/185 B |
| 3,824,979 | 7/1974 | Tajika et al. | 123/185 A |
| 3,871,350 | 3/1975 | Hamman | 123/185 A |
| 4,019,490 | 4/1977 | Reese | 123/185 A |
| 4,359,021 | 11/1982 | Frahm | 123/185 BA |

*Primary Examiner*—Andrew M. Dolinar

*Attorney, Agent, or Firm*—Albert L. Jeffers; John F. Hoffman

[57] ABSTRACT

A top mounting pull-rope recoil starter as might be employed on a vertical crankshaft small internal combustion engine for rotary lawnmower or similar applications. The pull-rope pulley connects to a ratchet wheel through a twist-lock coupling and the spring chamber formed within the ratchet wheel and pulley is sealed against dust by a rotating seal formed between the pulley and starter housing. The ratchet wheel is selectively engaged by engine flywheel supported pawls, which have integral leaf springs normally biasing them into engagement with the ratchet wheel. When the engine is running, however, the centrifugal force generated by the rotating flywheel on the pawls moves the pawls against the bias of the integral leaf springs out of engagement with the ratchet wheel. The blower housing and starter housing are coupled together by a twist lock arrangement, and securely fastened together by a fastener, such as a threaded screw or a rivet passing through the starter housing into the blower housing. The starter housing is made of a molded plastic and includes a flexible lower rim which fits around a rigid upper rim of the blower housing, the latter locating and reinforcing the starter housing rim.

31 Claims, 14 Drawing Figures

FIG. 7
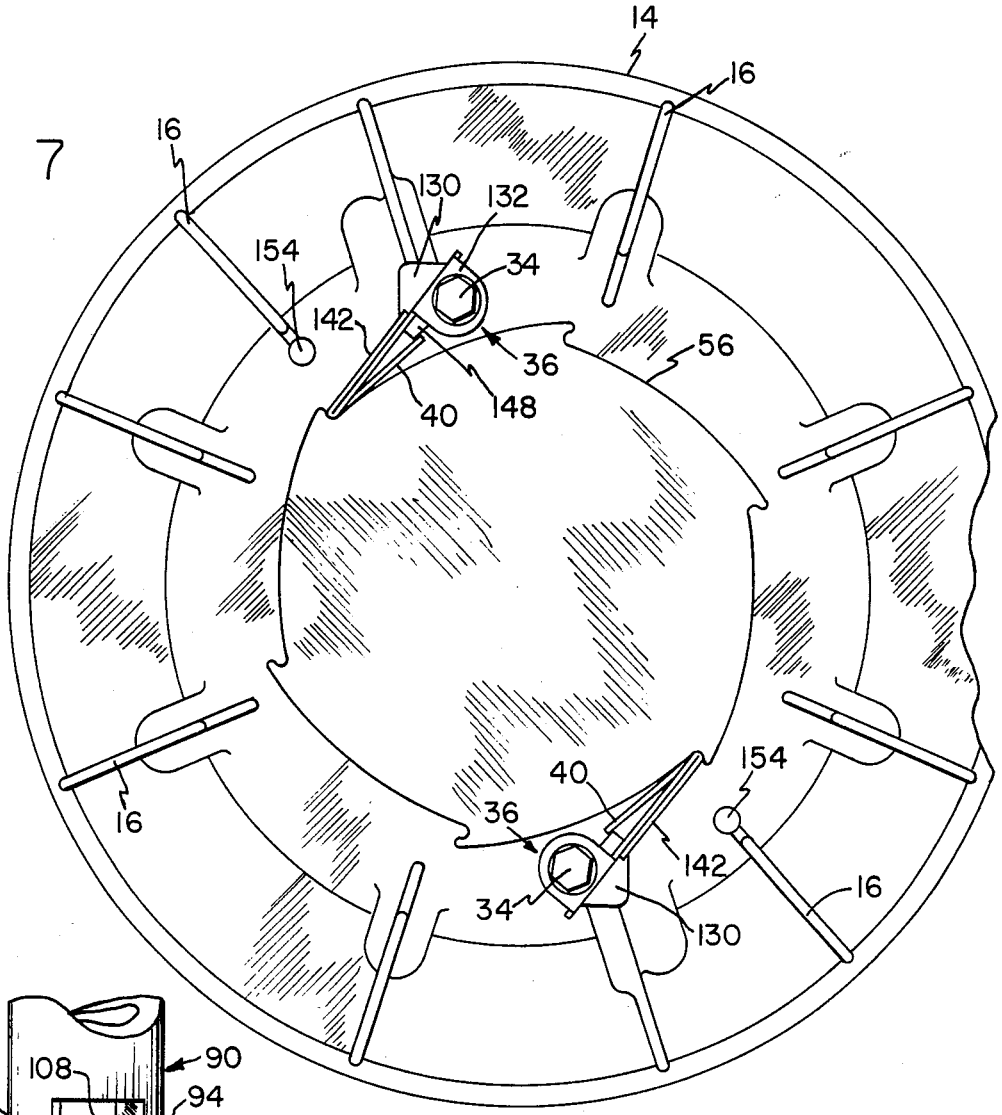
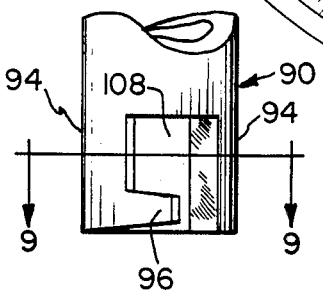
FIG. 8
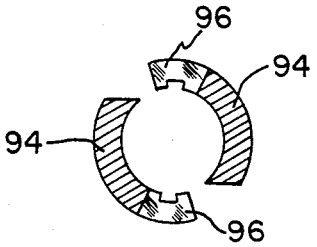
FIG. 9
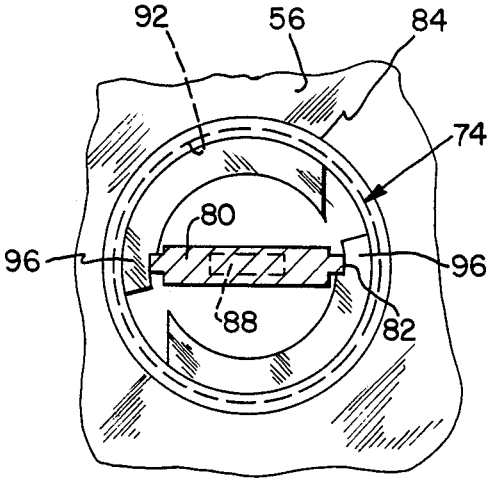
FIG. 10

MOUNTING RECOIL STARTER

BACKGROUND OF THE INVENTION

The present invention relates to a recoil starter mechanism for small internal combustion engines, for example, engines used on rotary lawnmowers.

Manual starting of a small internal combustion engine is frequently accomplished by a recoil pull-rope arrangement wherein a starting rope is coiled about a pulley and a starter gear arrangement is coupled to the pulley so that when the rope is pulled and unwound from the pulley, the pulley rotates and the starter gear arrangement is translated in one direction or another to engage a mating starter gear on the engine. A spiral spring associated with the pulley or starter gear arrangement rewinds the rope on the pulley when the handle is released. The translational movement of the starter gear out of engagement from the corresponding gear on the engine enables the engine to run freely without turning the recoil starting arrangement. In U.S. Pat. No. 4,019,490, there is disclosed a pulley and starter gear mechanism which translates in a direction generally perpendicular to their common axis of rotation to engage the gear associated with the pull-rope and a mating set of teeth on the engine flywheel.

Also known is a fixed axis pulley arrangement with a threaded hub member coupling the pulley and starter gear together so that initial rotation of the starter pulley urges the starter gear axially into engagement with mating teeth on the engine flywheel.

Centrifugally decoupled starting arrangements have also been employed wherein the engine flywheel or other rotating part of the engine carries one or more starter lugs spring biased to engage a ratchet wheel or pull-rope starter gear and, when the engine is started, the centrifugal force effect on the pawls moves them radially outwardly against the spring biasing and out of engagement with the starter ratchet wheel. Such lug type starter arrangements have enjoyed some commercial success, for example, in chain saws, but have not been as successful in more competitive markets of lawnmowers, snow throwers and similar applications due, at least in part, to the expense and complexity of assembly of the centrifugally actuated pawls.

Frequently, the small internal combustion engines to which the present invention applies employ a crankshaft driven flywheel having a series of vanes annularly disposed thereon for circulating air about the engine to cool the engine. Such an air circulating flywheel is frequently enclosed within a blower housing both for safety reasons and to appropriately duct the air about the engine for cooling purposes. The starter housing is often constructed as a separate part and is joined to the blower housing by fasteners, such as metal screws, for example. The use of a plurality of fasteners to connect the starter and blower housings results in increased assembly time.

The recoil spring is typically located within a chamber inside of the pulley or ratchet wheel, and the spring is often coated with an oil to prevent rusting and ensure smooth operation. A significant problem is the accumulation of dust on the oil coated recoil spring, because the accumulation of dust will begin to buildup between the coils of the spring thereby preventing the spring from being completely coiled when the rope is pulled. Dust build up also prevents the spring from completely recoiling when it is released so that the rope will not be completely retracted within the starter housing.

SUMMARY OF THE INVENTION

Among the several objects of the present invention may be noted the overall reduction in the cost of fabricating a small internal combustion engine; the provision of a relatively dust proof and easily assembled pull-rope recoil spring assembly; the provision of a simple pawl arrangement for selectively drivingly interconnecting a ratchet wheel and flywheel for pull-rope starting an engine; the provision of a less complex technique for assembling the starter housing to the blower housing; and the provision of an improved and simpler technique for assembling a recoil biased pull-rope pulley to a hub axially aligned with an engine flywheel axis. These as well as other objects and advantages of the present invention, in the various forms set forth in the claims, will be apparent from the detailed description of a preferred embodiment which follows.

In accordance with one embodiment of the invention, there is provided a pull-rope recoil starter mechanism for a small internal combustion engine of the type having an air circulating crankshaft driven flywheel enclosed within a vented starter housing and a pull-rope actuatable rotatable ratchet wheel mounted within the starter housing generally axially aligned with and adjacent the flywheel. An improved pawl arrangement for selectively drivingly interconnecting the ratchet wheel and flywheel for pull-rope starting the engine comprises a plurality of pivots distributed on the flywheel radially beyond the ratchet wheel, and a plurality of pawls mounted respectively on the pivots for pivotal movement about axes generally parallel to the axis of rotation of the flywheel. Each pawl has an integral bias leaf spring for urging the pawl into engagement with the ratchet wheel and an inertial mass center displaced from its pivot axis urging the pawl under centrifugal force against the spring bias out of ratchet engagement upon adequate flywheel rotation.

The invention, in accordance with another form thereof, provides a pull-rope recoil starter mechanism for a small internal combustion engine of the type having an air circulating crankshaft driven flywheel enclosed within a blower housing having a removable vented starter housing made of a molded plastic, and a pull-rope actuatable arrangement for engaging and driving the flywheel to start the engine mounted within the starter housing. An improved arrangement for removeably attaching the starter housing to the blower housing comprises a plurality of locking tabs formed integrally with one of the blower housing and starter housing and distributed about a generally circular pattern, and a like plurality of tab receiving notches distributed about the other of the blower housing and starter housing in a generally circular pattern with the tabs and notches mating in a twist-lock manner to secure the starter housing in position on the blower housing. The blower housing incorporates an upstanding circular rim around which the starter housing closely fits to thereby center and reinforce the starter housing rim. One or two fasteners, such as a screw or rivet, may be passed through the starter housing and blower housing to prevent inadvertent relative rotation thereby causing removal of the starter housing from the blower housing.

The pulley and ratchet wheel of the pull-rope recoil starter are held in axial location relative to a center post of the starter housing, about which the pulley and ratchet wheel may rotate. One end of the recoil spring extends through aligned openings in the bushing and starter housing post, and tension on the spring keeps the bushing and starter housing post locked together. A flange on the bushing retains the ratchet wheel and pulley in assembled condition. The rachet wheel serves as a retainer to which the recoil spring is sub-assembled by an automated machine. This further simplifies the assembly of the starter.

The enclosure formed by the ratchet wheel and pulley protects the recoil spring from dust, and an integral rotating seal between the starter housing and a tapered hub on the pulley protects the pulley support bearing and the spring from dust.

The ratchet wheel and pull-rope receiving pulley are joined by a plurality of lugs distributed about one surface of the ratchet wheel and a like plurality of lug receiving lips or slots are distributed about one surface of the pulley so that the pulley and ratchet wheel may be engaged and rotated to lock the lugs and slots together in a twist-lock fashion.

The invention also provides, in accordance with one form thereof, a pull-rope recoil starter mechanism for a small internal combustion engine comprising a blower housing having a generally circular rigid upper rim, and a crankshaft driven flywheel enclosed within the blower housing. A removable vented starter housing of molded plastic having a generally circular flexible lower rim is closely fitted about the blower housing rim, and the blower housing rim serves to locate and reinforce the starter housing lower rim. Means on the starter housing and blower housing rims removably interlock the starter and blower housings.

BRIEF DESCRIPTION OF THE DRAWINGS

FIG. 7 is a fragmentary plan view of a portion of the flywheel showing the pawls;

FIG. 8 is an enlarged elevational view of the lower portion of the starter housing hub;

FIG. 9 is a sectional view taken along line 9—9 of FIG. 8 and viewed in the direction of the arrows;

FIG. 10 is a sectional view taken along line 10—10 of FIG. 1 and viewed in the direction of the arrows;

DESCRIPTION OF A PREFERRED EMBODIMENT

Figure 1:
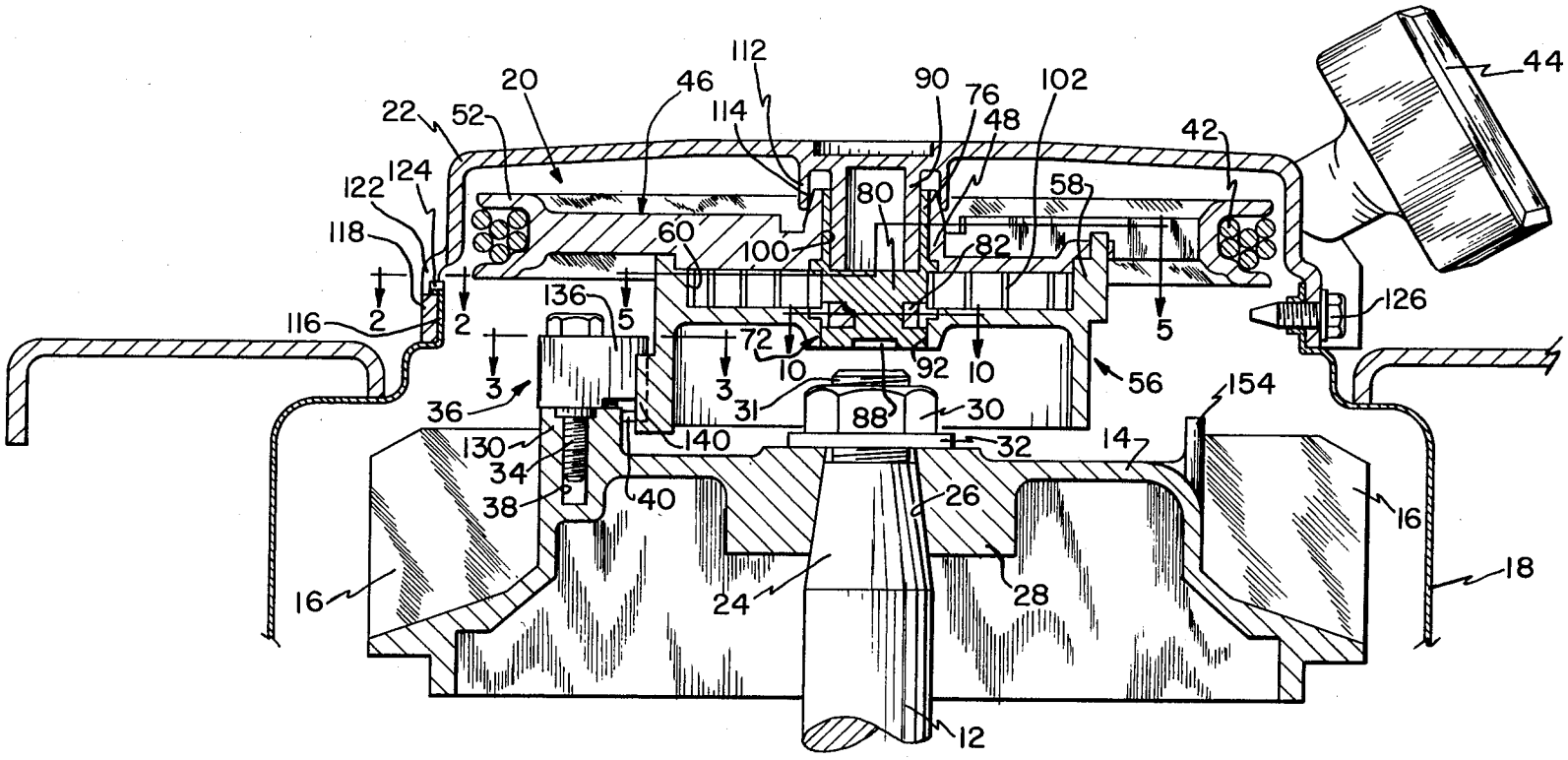
FIG. 1 is a side elevation view in cross-section of the upper portion of a small internal combustion engine embodying the present invention in accordance with one form thereof.

Referring now to FIG. 1, there is illustrated the upper portion of an otherwise conventional small internal combustion engine of the vertical crankshaft variety as might be used to power a rotary lawnmower, for example. The engine crankshaft 12 is keyed to flywheel 14, which preferably includes air circulating blades or vanes 16 for air cooling of the engine. Air circulating flywheel 14 is partially enclosed within blower housing 18, which is typically made of steel. A manual recoil starting arrangement 20 is positioned above flywheel 14 and is enclosed within starter housing 22, which is preferably made of a molded plastic, such as high density polyethylene. The upper end 24 of crankshaft 12 is tapered and is received in a correspondingly tapered opening 26 in the hub 28 of flywheel 14. Nut 30 is threaded on the upper end 31 of crankshaft 12 and, together with washer 32, serves to retain flywheel 14 on crankshaft 12.

Figure 3:
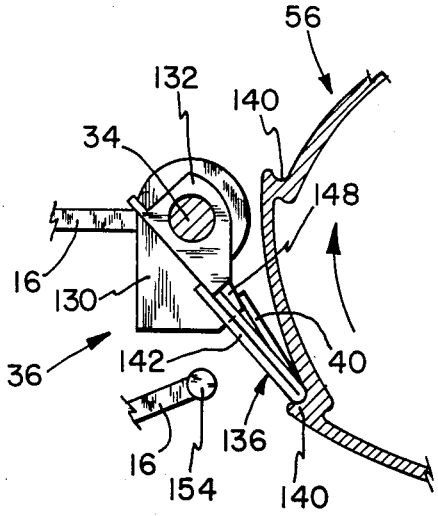
FIGS. 3 and 3*a* are enlarged fragmentary sectional views taken along line 3—3 of FIG. 1 and viewed in the direction of the arrows, and illustrating the pawl engaged and disengaged, respectively, with the ratchet wheel.
Figure 3A:
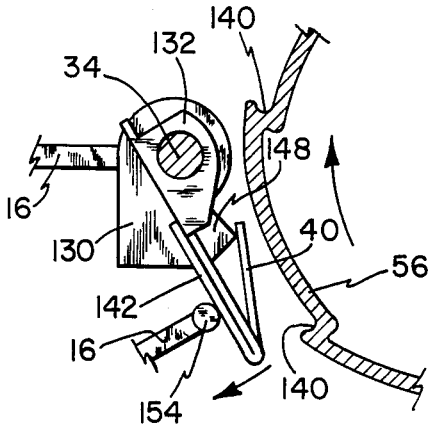
Figure 4:
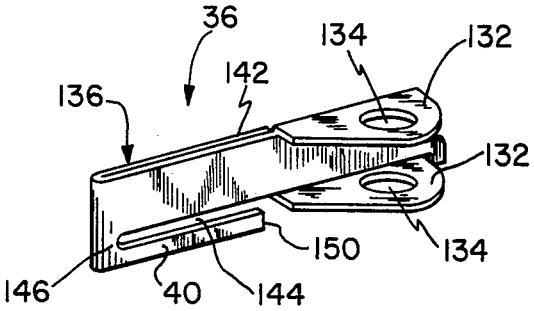
FIG. 4 is an enlarged perspective view of one of the pawls.

Flywheel 14 has a pivot thereon, which may be a bolt 34 as illustrated in the disclosed embodiment, an integral stud or other device for pivotally supporting a self-biasing spring pawl 36, which is illustrated in greater detail in FIGS. 3, 3*a* and 4. Bolt 34 is threadedly received in tapped bore 38. In practice, a plurality of such pawls 36, such as two or three, are uniformly distributed about flywheel 14 with each of the pawls 36 being of generally the same construction having a small spring tab 40 (FIG. 4) which performs the self-biasing function urging the pawl toward the position illustrated in FIG. 3. The effective center of mass of the pawl 36 is displaced radially outward from the pivot axis defined by bolt 34 so that when flywheel 14, which supports pawls 36, rotates at a sufficiently high speed, centrifugal force urges the pawls 36 outwardly toward the position illustrated in FIG. 3*a* against the biasing of spring tab 40. The operation of pawls 36 will be described in greater detail hereinafter.

A pull-rope 42 having an operator graspable handle 44 is wrapped around pulley 46 with the inner end of rope 42 fixed to pulley 46 so that when the operator pulls handle 44, pulley 46 rotates in a clockwise direction as viewed from the top in FIG. 1. Pulley 46, which may be made of a molded plastic, such as nylon, includes a center hub portion 48 having a tapered annular surface 114, and hub portion 48 is connected to annular outer portion 52 by a plurality of spokes 54. Pulley 46 is connected to ratchet wheel 56, the latter including an annular wall 58 which forms a spring chamber 60 between ratchet wheel 56 and pulley 46. Ratchet wheel 56 may be made of the same material as pulley 46.

A twist-lock coupling between rope receiving pulley 46 and ratchet wheel 56, in a rotational sense such that a pull on pull-rope 42 tends to tighten the coupling between pulley 46 and ratchet wheel 56, is achieved by providing a plurality of lugs 62 on ratchet wheel 56 in a generally circular pattern near the upper ratchet wheel surface as viewed in FIG. 1. A like plurality of similarly distributed lug receiving lips 64 are provided on pulley 46 so that the pulley and ratchet wheel may be joined by simply juxtaposing the lugs 62 and lips 64 and executing a relative rotational movement between the ratchet wheel 56 and pulley 46. This twist-lock coupling is facilitated somewhat by configuring the lips 64 to have a ramp 66 along which the tips 68 of lugs 62 slide during the twist lock operation, with that operation terminating when tips 68 fall into respective notches 70 in pulley 46 so as to securely lock the two parts together. Thus, assembly time is reduced by the simple twist lock coupling of the ratchet wheel 56 and pulley 46. By way of example, ratchet wheel 56 may include six lugs and pulley 46 six corresponding lips.

Figure 11:
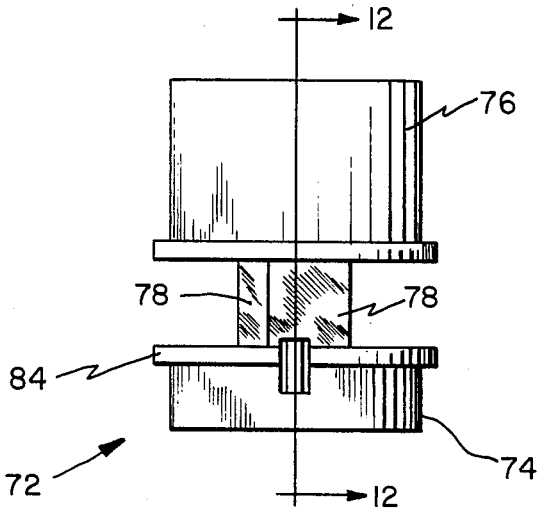
FIG. 11 is an enlarged elevational view of the bushing.
Figure 12:
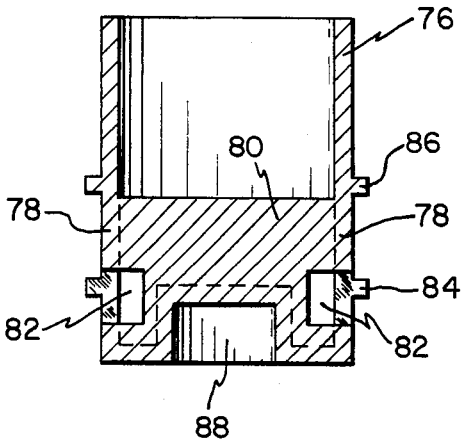
FIG. 12 is a sectional view of FIG. 11 taken along line 12—12 and viewed in the direction of the arrows.

The pulley and ratchet wheel assembly is connected to and supported by starter housing 22 by means of bushing 72, which may be made of nylon, for example. Bushing 72 is shown in detail in FIGS. 11 and 12, and comprises a base portion 74, an upper wall portion 76 connected to base portion 74 by web portions 78 and spanner 80. Spanner 80 includes a pair of locking tab receiving openings 82, and flanges 84 and 86 are provided on base 74 and upper wall portion 76, respectively. A slot 88 within base portion 74 is for the purpose of accommodating a screwdriver or other tool to lock bushing 72 to starter housing post 90 (FIG. 1) in a manner to be described hereinafter.

Base 74 of bushing 72 is disposed within the center opening 92 of ratchet wheel 56 as shown in FIGS. 1 and 10, and lower flange 84 seats against ratchet wheel 56. The lower portion of starter housing post 90 is bifurcated to form a pair of legs 94, each of which includes a locking tab 96 (FIGS. 8, 9 and 10) Post 90 extends through bushing 72, past spanner 80 until the locking tabs 96 are aligned with openings 82 in bushing 72. By twisting bushing 72, locking tabs 96 are caused to enter openings 82 in bushing 72 thereby locking bushing 72, ratchet wheel 56, pulley 46 and starter housing 22 together. Bushing 72 extends through opening 100 in pulley hub portion 48, so that the upper wall portion 76 of bushing 72 serves as the bearing for pulley 46. In this manner, pulley 46 and ratchet wheel 56 are rotatably suspended from starter housing 22 through the interconnection of starter housing post 90 and bushing 72.

Figure 5:
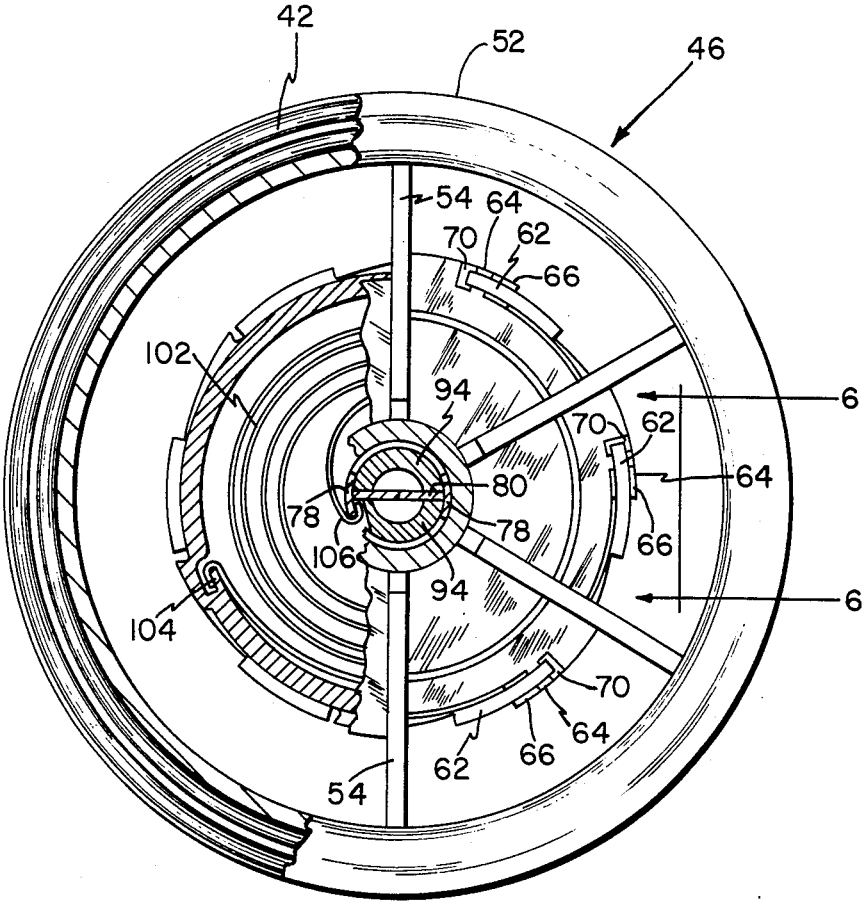
FIG. 5 is a sectional view taken along line 5—5 of FIG. 1 and viewed in the direction of the arrows.
Figure 6:
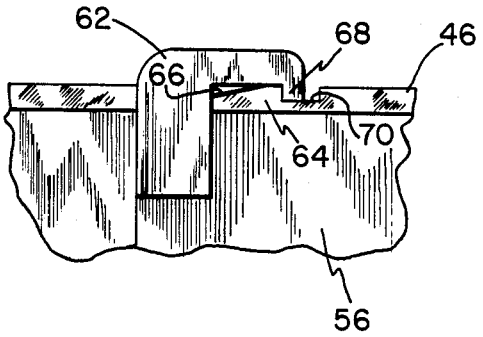
FIG. 6 is a sectional view taken along line 6—6 of FIG. 5 and viewed in the direction of the arrows.

A spiral steel spring 102 is disposed within spring chamber 60 and has its outer end connected to a tab 104 on ratchet wheel 56 (FIG. 5). Its inner end 106 hooks around web portion 78 on bushing 72 through an opening 108 in the lower portion of post 90 just above locking tab 96. The orientation of spring 102 is such that its tension tends to rotate bushing 72 in a direction which locks locking tabs 76 within openings 82 in bushing 72.

When pull-rope 42 is withdrawn, pulley 46 and ratchet wheel 56 will be rotated about bushing 72 thereby winding spring 102 about bushing 72. When rope 42 is released, spring 102 will unwind and cause pulley 46 to retract rope 42 within starter housing 22.

Starter housing 22 includes a downwardly depending annular shield 112 (FIG. 1) which seats against tapered surface 114 of pulley hub portion 48 thereby forming a rotating seal which prevents the entry of dust into the bearing surface between bushing 72 and pulley 46. This dust seal also prevents dust from entering spring chamber 60.

Figure 2:
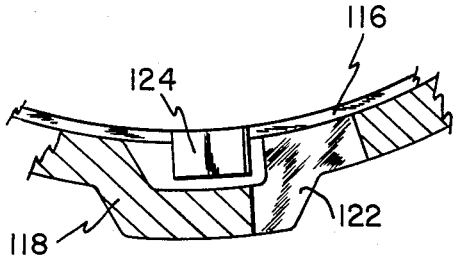
FIGS. 2 and 2*a* are enlarged, fragmentary cross-sectional views taken along line 2—2 of FIG. 1 and viewed in the direction of the arrows, and illustrate the starter and blower housings in their unlocked and locked positions, respectively.
Figure 2A:
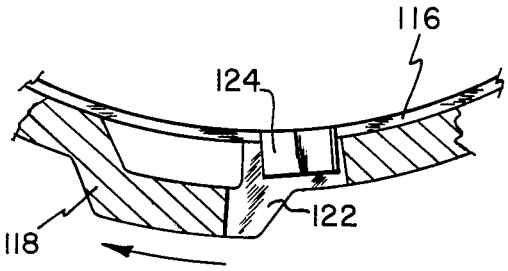

With reference now to FIGS. 1, 2 and 2*a*, the interconnection between starter housing 22 and blower housing 18 will be described. Blower housing 18, which is preferably made of a metal such as steel, includes an annular upper rim 116 over which the lower rim 118 of starter housing 22 closely fits. Since starter housing 22 is made of a molded plastic, its rim 118 is relatively flexible, and the rigid upper rim 116 of blower housing 18 serves to both locate and reinforce starter housing rim 118 from excessive distortion under cranking loads as the engine is started. A plurality of L-shaped notches 122 (FIGS. 2 and 2*a*) distributed in a generally circular pattern about the lower rim 118 of starter housing 22 engage a like plurality of tabs 124 similarly positioned about the upper rim 116 of blower housing 18. A simple twist lock motion as depicted in FIGS. 2 and 2*a* locks tabs 124 within notches 122 ensuring that starter housing 22 can now only be removed from blower housing 18 by first relative rotation between those two members and then lifting starter housing 22 from blower housing 18.

Once starter housing 22 is twist locked into position on blower housing 18, a fastener 126, such as a rivet or screw, is passed through starter housing 22 and blower housing 18 so as to prevent relative rotation between those members. By this arrangement, the prior art technique of employing four or five screws around the periphery of the starter and blower housings has been replaced by the use of a single fastener which prevents rotation and therefore ensures that locking tabs 124 remain in their locked position.

Details of the structure and function of the pawl arrangement which selectively drivingly interconnects ratchet wheel 56 and flywheel 14 to enable pull-rope starting of the engine will now be described with reference to FIGS. 1, 3, 3*a*, 4 and 7. A plurality of bosses 130, such as two, are upstanding from flywheel 14 and preferably equiangularly distributed about flywheel 14. Bosses 130 are arranged generally in a circular fashion centered at the axis of crankshaft 12 so that bosses 130 are radially beyond ratchet wheel 56. Bolts 34, or other pivot means, are received in tapped bores 38 in bosses 130 and serve to mount a like plurality of pawls 36 on bosses 130 so that the respective pawls 36 may pivot about the axis of bolts 34, with the pivot axis of pawls 34 being generally parallel to the axis of crankshaft 12.

Each pawl is formed from a single piece of stock spring steel material bent to form a pair of tabs 132 having a pair of apertures 134 therein through which bolt 34 passes. Bolt 34 may have an enlarged smooth region or a sleeve or other bushing to provide a smooth pivot, if desired. Each pawl 36 also includes a bifurcated arm 136 extending from the pivotal coupling formed by tabs 132 and bolt 34 so that the center of mass of pawl 36 is positioned somewhere along arm 136 and off the axis of bolt 34. This causes the centrifugal force exerted on each pawl 36 as flywheel 14 rotates to urge pawl 36 from the position illustrated in FIG. 3 to the position illustrated in FIG. 3*a*. Thus, FIG. 3 illustrates the flywheel at rest with the arm 136 engaging one of the several notches 140 in ratchet wheel 56. The number of notches 140 in ratchet wheel 56 should, of course, be an integral multiple of the number of pawls 34 uniformly distributed about flywheel 14 so that all pawls are engaged by ratchet wheel 56 to be driven thereby during starting of the engine.

Arm 36 includes an upper portion 142 which is double thickness, and a lower portion thereof is formed as a leaf spring 40 separated from the upper portion 142 of arm 36 by L-shaped notch 144. Leaf spring 40, which is integral with the remainder of pawl 36 is connected to arm upper portion 142 about hinge portion 146 near the free end of arm 136.

Boss 130 includes a projecting portion 148 which is positioned to be engaged by the free end 150 of leaf spring 40 as pawl 36 is rotated outwardly to the position shown in FIG. 3*a* by the centifugal force of rotating flywheel 14. Leaf spring 40 tends to pull pawl 36 radially inward as shown in FIG. 3 when flywheel 14 is at rest so that the free end of pawl arm 136 will be received within a notch 140 in ratchet wheel 56. There is slight tension on leaf spring 40 even at the rest position shown in FIG. 3 so as to positively retain pawl 36 in engagement with a notch 140 on ratchet wheel 56. An initial pull on handle 44 will cause ratchet wheel 56 to turn flywheel 14 through the engagement of pawls 36 with respective notches 140 on ratchet wheel 56. When the engine begins to run, the rotation of flywheel 14 will exert centrifugal force on pawls 36 thereby causing them to rotate outwardly against the biasing force produced by leaf springs 40 engaging projections 148 to the position shown in FIG. *3a*. When the engine continues to run, flywheel 14 will continue to rotate at a high rate of speed thereby ensuring that pawls 36 remain in their disengaged positions shown in FIG. *3a*. An upstranding post 154 on a vane 16 located behind pawl 36 serves as a stop to prevent excessive outward rotation of the pawl 36 as shown in FIG. *3a*.

In the foregoing, it will be apparent that a novel recoil starter assembly employing twist-locking features and a unique starter pawl configuration has been disclosed meeting the objects and advantages set out herein.

While this invention has been described as having a preferred design, it will be understood that it is capable of further modification. This application is, therefore, intended to cover any variations, uses, or adaptations of the invention following the general principles thereof and including such departures from the present disclosure as come within known or customary practice in the art to which this invention pertains and fall within the limits of the appended claims.

What is claimed is:

1. In a pull rope recoil starter mechanism for a small internal combustion engine of the type having an air circulating crankshaft driven flywheel enclosed within a blower housing having a removable vented starter housing made of a molded plastic, and a pull rope actuatable arrangement for engaging and driving the flywheel to start the engine mounted within the starter housing, an improved arrangement for removably attaching the starter housing to the blower housing comprising:

a plurality of locking tabs formed integrally with one of the blower housing and starter housing and distributed about a generally circular pattern;

a like plurality of tab receiving notches distributed about the other of the blower housing and starter housing in a generally circular pattern with the tabs and notches mating in a twist-lock manner to secure the starter housing in position on the blower housing.

2. The starter mechanism of claim 1 further comprising a fastener passing through both the starter housing and blower housing to prevent unlocking of the tabs and notches and removal of the starter housing from the blower housing.

3. The starter mechanism of claim 1 wherein the pull rope actuatable arrangement includes a ratchet wheel rotatable by the pull rope and a pawl array for selectively drivingly interconnecting the ratchet wheel and flywheel for pull rope starting the engine, the pawl arrangement comprising:

a plurality of bosses upstanding from and distributed about the flywheel radially beyond the ratchet wheel; and a like plurality of pawls mounted one each on the bosses for pivotal movement about axes generally parallel to the axis of rotation of the flywheel, each pawl having an integral bias leaf spring means for urging the pawl into engagement with the ratchet wheel and an inertial mass center displaced from its pivot axis urging the pawl against the spring bias out of ratchet engagement upon adequate flywheel rotation.

4. The starter mechanism of claim 3 wherein the flywheel includes a plurality of air circulating vanes annularly disposed about the periphery thereof, pivotal pawl movement away from the ratchet wheel due to flywheel rotation being limited by pawl engagement with a vane.

5. The starter mechanism of claim 3 further comprising a pulley for receiving a pull rope coupled to and rotatable with the ratchet wheel, a spiral spring having an outer end fastened to the ratchet wheel and an inner end fastened to a bushing locked to a center post portion of the starter housing with the spring wound about the bushing in a sense opposite the direction in which the pull rope is to be wound about the pulley so that withdrawl of the pull rope from the pulley rotates the pulley and ratchet wheel relative to the bushing and post portion in a direction to wind the spring more tightly about the bushing and to more tightly lock the bushing to the center post portion.

6. The starter mechanism of claim 5 wherein said bushing is twist locked to the center post portion of said starter housing.

7. The starter mechanism of claim 6 wherein said bushing includes flanges respectively in engagement with said ratchet wheel and pulley and serving to connect said ratchet wheel and pulley to said starter housing.

8. The starter mechanism of claim 3 wherein each pawl is formed from a sheet spring material having a bifurcated arm, wherein one portion of the bifurcated arm forms an integral leaf spring which urges the other portion of the arm into engagement with the ratchet wheel.

9. The starter mechanism of claim 8 wherein the pawl includes a bent over appertured tab at one end forming part of a pivotal connection between the pawl and flywheel, and the integral leaf spring is joined to said other portion of the bifurcated arm at a free end of the arm opposite the pivotal connection.

10. The starter mechanism of claim 1 wherein the pull rope arrangement includes a ratchet wheel and a pull rope receiving pulley twist lock coupled to the ratchet wheel in a direction such that a pull on the pull rope tends to tighten the coupling between the pulley and ratchet wheel.

11. A pull rope recoil starter mechanism for a small internal combustion engine comprising:

a blower housing having a generally circular, rigid upper rim, a crankshaft driven flywheel enclosed within said blower housing, a removeable vented starter housing of molded plastic having a generally circular flexible lower rim, said starter housing lower rim being concentric with and closely fitting around the blower housing rim, said blower housing rim serving to locate and reinforce the starter housing lower rim, and means on said starter housing and blower housing rims for removeably interlocking said starter and blower housings by relative interlocking movement between said housings.

12. The starter mechanism of claim 11 wherein the pull rope actuatable arrangement includes a ratchet wheel rotatable by the pull rope and a pawl arrangement for selectively drivingly interconnecting the ratchet wheel and flywheel for pull rope starting the engine, the pawl arrangement comprising:

a plurality of bosses upstanding from and distributed about the flywheel radially beyond the ratchet wheel; and a like plurality of pawls mounted one each on the bosses for pivotal movement about axes generally parallel to the axis of rotation of the flywheel, each pawl having an integral bias leaf spring means for urging the pawl into engagement with the ratchet wheel and an inertial mass center displaced from its pivot axis urging the pawl against the spring bias out of ratchet engagement upon adequate flywheel rotation.

13. In a pull rope recoil starter mechanism for a small internal combustion engine of the type having a crankshaft driven flywheel, a pulley for receiving a pull rope, a ratchet wheel coupled to the pulley for rotation therewith as the pull rope is unreeled from the pulley, and a pawl arrangement for selectively drivingly interconnecting the ratchet wheel and flywheel for pull rope starting the engine, an improved arrangement for fastening the pulley and ratchet wheel together for corotation about the axis of a fixed hub comprising:

a plurality of first locking elements distributed about a generally circular pattern on the ratchet wheel; and a plurality of second locking elements distributed in a generally circular pattern on the pulley, said first and second locking elements being removably interlocked in a twist-lock manner by relative rotation between the ratchet wheel and pulley.

14. The starter mechanism of claim 13 further comprising a spiral recoil spring having an outer end hooked over a portion of the ratchet wheel and and inner end fastened to the hub with the spring wound about the hub in a sense opposite the direction in which the pull rope is to be wound about the pulley so that withdrawl of the pull rope from the pulley rotates the pulley and ratchet wheel in a direction to wind the spring more tightly about the hub.

15. The starter mechanism of claim 14 wherein the spring biases the ratchet wheel and pulley in opposite rotational directions to urge the first and second locking elements into interlocked positions.

16. The starter mechanism of claim 13 wherein said first locking elements are lugs on said ratchet and said second locking elements are lug receiving slots on said pulley.

17. A pull rope recoil starter mechanism for a small internal combustion engine of the type having an air circulating crankshaft driven flywheel enclosed within a blower housing and a pull rope actuatable rotatable ratchet wheel mounted within a starter housing generally axially aligned with and adjacent the flywheel, said starter mechanism comprising: a pulley for receiving a pull rope coupled to and rotatable with the ratchet wheel, a spiral spring having an outer end fastened to the ratchet wheel and an inner end fastened to a bushing which in turn is fastened to a post on the starter housing, the spring being wound about the bushing in a sense opposite the direction in which a pull rope is to be wound about the pulley so that withdrawl of the pull rope from the pulley rotates the pulley and ratchet wheel in a direction to wind the spring more tightly about the bushing, the bushing providing the means for holding the ratchet wheel and pulley axially in position on the post of the starter housing, and an improved pawl arrangement for selectively drivingly interconnecting the ratchet wheel and flywheel for pull rope starting the engine including a plurality of pivot means distributed about the flywheel radially beyond the ratchet wheel, and a plurality of pawls mounted respectively on the pivot means for pivotal movement about an axis generally parallel to the axis of rotation of the flywheel, each pawl having an integral biased leaf spring means for urging the pawl into engagement with the ratchet wheel and an inertial mass center displaced from its pivot axis urging the pawl under centrifugal force against the spring bias out of ratchet engagement upon adequate flywheel rotation.

18. A pull rope recoil starter mechanism for a small internal combustion engine of the type having an air circulating crankshaft driven flywheel enclosed within a blower housing and a pull rope actuatable rotatable ratchet wheel mounted within a starter housing generally axially aligned with and adjacent the flywheel comprising: a pawl arrangement for selectively, drivingly interconnecting the ratchet wheel and flywheel for pull rope starting the engine including a plurality of pivot means distributed about the flywheel radially beyond the ratchet wheel and a plurality of pawls mounted respectively on the pivot means for pivotal movement about axes generally parallel to the axis of rotation of the flywheel, each pawl having an integral biased leaf spring means for urging the pawl into engagement with the ratchet wheel and an inertial mass center displaced from its pivot axis urging the pawl under centrifugal force against the spring bias out of ratchet engagement upon adequate flywheel rotation, the starter housing including a plurality of notches that receive a corresponding plurality of tabs on a mating part of the engine in a twist-lock manner for fastening the starter housing securely in position on the engine.

19. The starter mechanism of claim 18 wherein said tabs are on a blower housing of the engine and further comprising a fastener passing through the starter housing and into the blower housing on the engine to prevent rotation of the starter housing relative to the blower housing thereby preventing unlocking of the mating tabs and notches.

20. A pull rope recoil starter mechanism for a small internal combustion engine of the type having an air circulating crankshaft driven flywheel enclosed within a blower housing and a pull rope actuatable rotatable ratchet wheel mounted within a starter housing generally axially aligned with and adjacent the flywheel comprising: a pawl arrangement for selectively, drivingly interconnecting the ratchet wheel and flywheel for pull rope starting the engine including a plurality of pivot means distributed about the flywheel radially beyond the ratchet wheel and a plurality of pawls mounted respectively on the pivot means for pivotal movement about axes generally parallel to the axis of rotation of the flywheel, each pawl having an integral biased leaf spring means for urging the pawl into engagement with the ratchet wheel and an inertial mass center displaced from its pivot axis urging the pawl under centrifugal force against the spring bias out of ratchet engagement upon adequate flywheel rotation, and a pull rope receiving pulley twist-lock coupled to the ratchet wheel in a direction such that a pull on the pull rope tends to tighten the coupling between the pulley and ratchet wheel.

21. In a pull rope recoil starter mechanism for a small internal combustion engine of the type having an air circulating crankshaft driven flywheel enclosed within a blower housing and a pull rope actuatable rotatable ratchet wheel mounted within a starter housing generally axially aligned with and adjacent the flywheel, an improved pawl arrangement for selectively drivingly interconnecting the ratchet wheel and flywheel for pull rope starting the engine comprising:

a plurality of pivot means distributed about the flywheel radially beyond the ratchet wheel; and a plurality of pawls mounted respectively on the pivot means for pivotal movement about axes generally parallel to the axis of rotation of the flywheel, each pawl having an integral biased leaf spring means for urging the pawl into engagement with the ratchet wheel and an inertial mass center displaced from its pivot axis urging the pawl under centrifugal force against the spring bias out of ratchet engagement upon adequate flywheel rotation;

said pawls each being formed from sheet spring material with a bent over apertured tab at one end forming part of a pivotal coupling between the pawl and flywheel.

22. The starter mechanism of claim 21, wherein said pawls each includes a bifurcated arm extending from the pivotal coupling, the integral bias spring means comprising one portion of the bifurcated arm.

23. In a pull rope recoil starter mechanism for a small internal combustion engine of the type having an air circulating crankshaft driven flywheel enclosed within a blower housing and a pull rope actuatable rotatable ratchet wheel mounted within a starter housing generally axially aligned with and adjacent the flywheel, an improved pawl arrangement for selectively drivingly interconnecting the ratchet wheel and flywheel for pull rope starting the engine comprising:

a plurality of pivot means distributed about the flywheel radially beyond the ratchet wheel; and a plurality of pawls mounted respectively on the pivot means for pivotal movement about axes generally parallel to the axis of rotation of the flywheel, each pawl having an integral biased leaf spring means for urging the pawl into engagement with the ratchet wheel and an inertial mass center displaced from its pivot axis urging the pawl under centrifugal force against the spring bias out of ratchet engagement upon adequate flywheel rotation;

said pawls each including a bifurcated arm extending from a pivotal coupling to the flywheel, the integral bias leaf spring means comprising one portion of the bifurcated arm that is integrally connected to the other portion of the bifurcated arm, said two arm portions being joined at an end of the bifurcated arm remote from the pivotal coupling.

24. A pull rope recoil starter mechanism for a small internal combustion engine comprising:

a blower housing having a generally circular, rigid upper rim, a crankshaft driven flywheel enclosed within said blower housing, a removeable vented starter housing of molded plastic having a generally circular flexible lower rim, said starter housing lower rim being concentric with and closely fitting around the blower housing rim, said blower housing rim serving to locate and reinforce the starter housing lower rim;

means on said starter housing and blower housing rims for removeably interlocking said starter and blower housings; and said means for interlocking comprising a plurality of locking tabs on one of said blower housing rim and starter housing rim and a like plurality of tab receiving notches on the other of said blower housing and starter housing rims, said tabs and notches mating in a twist-lock manner to secure the starter housing in position on the blower housing.

25. The starter mechanism of claim 24 including a fastener passing through the blower housing and starter housing to prevent relative rotation therebetween and removal of the starter housing from the blower housing.

26. A pull rope recoil starter mechanism for a small internal combustion engine comprising:

a blower housing having a generally circular, rigid upper rim, a crankshaft driven flywheel enclosed within said blower housing, a removeable vented starter housing of molded plastic having a generally circular flexible lower rim, said starter housing lower rim being concentric with and closely fitting around the blower housing rim, said blower housing rim serving to locate and reinforce the starter housing lower rim;

means on said starter housing and blower housing rims for removeably interlocking said starter and blower housings; and a pulley for receiving a pull rope coupled to and rotatable with the ratchet wheel, a spiral spring having an outer end fastened to the ratchet wheel and an inner end fastened to a bushing locked to a center post portion of the starter housing with the spring wound about the bushing in a sense opposite the direction in which the pull rope is to be wound about the pulley so that withdrawl of the pull rope from the pulley rotates the pulley and ratchet wheel relative to the bushing and post portion in a direction to wind the spring more tightly about the bushing and to more tighly lock the bushing to the center post portion.

27. A pull rope recoil starter mechanism for a small internal combustion engine comprising:

a blower housing having a generally circular, rigid upper rim, a crankshaft driven flywheel enclosed within said blower housing, a removeable vented starter housing of molded plastic having a generally circular flexible lower rim, said starter housing lower rim being concentric with and closely fitting around the blower housing rim, said blower housing rim serving to locate and reinforce the starter housing lower rim;

means on said starter housing and blower housing rims for removeably interlocking said starter and blower housings;

a pulley having a pull rope wound thereon, a ratchet wheel connected to said pulley and forming with said pulley an enclosed spring chamber, a recoil spring disposed in said chamber; and a bushing fixedly connected to a center post on said starter housing, said pulley and ratchet wheel being rotatably supported on said bushing, an upper portion of said pulley and a center portion of said starter housing forming a rotating seal to prevent dust from entering the spring chamber.

28. In a pull rope recoil starter mechanism for a small internal combustion engine of the type having an air circulating crankshaft driven flywheel enclosed within a blower housing and a pull rope actuatable rotatable ratchet wheel mounted within a starter housing generally axially aligned with and adjacent the flywheel, an improved pawl arrangement for selectively drivingly interconnecting the ratchet wheel and flywheel for pull rope starting the engine comprising:

a pivot means on the flywheel radially beyond the ratchet wheel; and a unitary one piece pawl mounted on the pivot means for pivotal movement about an axis generally parallel to the axis of rotation of the flywheel, the pawl having an arm portion, a hinge portion, and a biased leaf spring means for urging the arm portion into engagement with the ratchet wheel, said arm portion, hinge portion and leaf spring means being formed from a single piece of sheet stock material, said pawl having an inertial mass center means displaced from its pivot axis urging the pawl under centrifugal force against the spring bias to move the arm portion out of ratchet engagement upon adequate flywheel rotation.

29. The starter mechanism of claim 28 wherein said spring means engages a projection on said flywheel to urge the respective pawl into engagement with the ratchet wheel.

30. The starter mechanism of claim 28 wherein said spring means engages a projection means on said flywheel for flexing said leaf spring means as said leaf spring means is urged against the projection means under the centrifugal force generated by flywheel rotation.

31. The starter mechanism of claim 28 wherein the flywheel includes stop means for engaging and limiting pivotal pawl movement away from the ratchet wheel due to flywheel rotation.

* * * * *

UNITED STATES PATENT AND TRADEMARK OFFICE

CERTIFICATE OF CORRECTION

PATENT NO. : 4,582,030

DATED : April 15, 1986

INVENTOR(S) : Paul T. Reese

It is certified that error appears in the above-identified patent and that said Letters Patent is hereby corrected as shown below:

In the Title, insert --TOP-- before "MOUNTING";

Col. 1, in the Title, insert --TOP-- before "MOUNTING";

Col. 6, line 35, insert --sheet-- after "of";

Col. 7, line 15, change "upstranding" to --upstanding--;

Claim 26, Col. 12, line 44, change "tighly" to --tightly--;

Claim 31, Col. 14, line 18, insert --a-- after "includes".

UNITED STATES PATENT AND TRADEMARK OFFICE

CERTIFICATE OF CORRECTION

PATENT NO. : 4,582,030

DATED : April 15, 1986

INVENTOR(S) : Paul T. Reese

It is certified that error appears in the above-identified patent and that said Letters Patent is hereby corrected as shown below:

Col. 5, line 25, insert --.-- after ")";

Claim 9, Col. 8, line 42, change "appertured" to --apertured--;

Claim 14, Col. 9, line 39, change "and" second occurrance to --an--;

Claim 14, Col. 9, line 42, change "withdrawl" to --withdrawal--;

Claim 26, Col. 12, line 40, change "withdrawl" to --withdrawal--.

Signed and Sealed this

*Twenty-ninth* Day of *July 1986*

[SEAL]

*Attest:*

DONALD J. QUIGG

*Attesting Officer*

*Commissioner of Patents and Trademarks*